US007982680B1

(12) United States Patent
Lopez

(10) Patent No.: US 7,982,680 B1
(45) Date of Patent: Jul. 19, 2011

(54) ANTENNAS PROVIDING NEAR-SPHERICAL COVERAGE WITH RIGHT-HAND CIRCULAR POLARIZATION FOR DIFFERENTIAL GPS USE

(75) Inventor: Alfred R. Lopez, Commack, NY (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 269 days.

(21) Appl. No.: 12/459,324

(22) Filed: Jun. 30, 2009

(51) Int. Cl.
*H01Q 13/00* (2006.01)

(52) U.S. Cl. ..... 343/780; 343/850

(58) Field of Classification Search ..... 343/780, 343/850

See application file for complete search history.

(56) References Cited

U.S. PATENT DOCUMENTS 6,414,647 B1 * 7/2002 Lee ..... 343/793
2009/0237314 A1 * 9/2009 Lalezari ..... 343/721

* cited by examiner

*Primary Examiner* — Tan Ho
(74) *Attorney, Agent, or Firm* — Kenneth P. Robinson

(57) ABSTRACT

Accuracy of derivation of local corrections to GPS signals for use for aircraft landing guidance is subject to effects of reflected multipath signals. Antennas with a near-spherical antenna pattern of right-hand circular polarization, except within a downward cone, provide suppression of reflected multipath GPS signals incident from all azimuth angles and all relevant elevation angles. For such an antenna a cylindrical top assembly may include spaced conductive disks with intermediate exciter members excited at increments of 90 degree phase and surrounded by a dielectric ring. A cylindrical base assembly may include signal absorbent top and side wall portions and a bottom conductive disk and may alternatively include a signal absorbent inner wall portion.

20 Claims, 4 Drawing Sheets

ANTENNAS PROVIDING NEAR-SPHERICAL COVERAGE WITH RIGHT-HAND CIRCULAR POLARIZATION FOR DIFFERENTIAL GPS USE

SEQUENCE LISTING (Not Applicable)

RELATED APPLICATIONS (Not Applicable)

FEDERALLY SPONSORED RESEARCH (Not Applicable)

BACKGROUND OF THE INVENTION

This invention relates, in particular, to antennas to receive signals from Global Positioning System (GPS) satellites for Differential GPS (DGPS) applications and more generally to antennas providing a near-spherical antenna pattern of circular polarization. For present purposes, such an antenna pattern is defined as providing a radiation pattern of circular polarization (e.g., right-hand circular polarization) in all directions, except within a downward cone having an acute internal angle.

Application of the GPS for aircraft approach and landing guidance is subject to various local and other errors limiting accuracy. Implementation of DGPS can provide local corrections to aircraft to improve accuracy of obtainable position information during landings. A DGPS surface (e.g., ground or ship) installation can provide local corrections for errors as may result from ionospheric and tropospheric effects and from satellite clock and ephemeris errors. Of particular significance for DGPS applications is the desirability of use of antennas having the characteristic of a unitary phase center of closely fixed position, to permit highly accurate determinations of phase of received signals and avoid introduction of phase discrepancies.

In surface installations of reference antennas for DGPS applications, reflected multipath signals generally represent the dominant contributor to the total system error. Such signals may be reflected from vertical surfaces and other objects, as well as from ground and water surfaces. In addition to adequate discrimination against ground or water surface reflections, a particular problem is the providing of adequate discrimination against multipath signals reflected from nearby objects and surfaces such as from masts, other antennas, etc., as when an antenna must be positioned on a ship in a crowded and space-limited environment, for example. It is also desirable that antennas for these and other applications be of reasonable size and cost-effective construction.

GPS satellite signals of right-hand circular polarization upon reflection undergo a change to left-hand circular polarization. Thus, in theory an ideal DGPS reference antenna would have an antenna pattern with right-hand circular polarization for all incident directions, that is, it would have a right-hand polarization pattern which was spherical. However, no known antenna design can provide such a spherical pattern and such a pattern is theoretically not realizable.

Objects of the present invention are to provide new and improved antennas, including such antennas usable for DGPS applications and which may provide an antenna pattern with a near-spherical same-hand circular polarization characteristic (with the term same-hand meaning one or the other of right-hand or left-hand circular polarization).

SUMMARY OF THE INVENTION

In accordance with the invention, an embodiment of an antenna, providing a near-spherical antenna pattern of right-hand circular polarization, may include the following:

- a cylindrical first assembly having a center axis and including a top portion having a conductive surface normal to the axis, a bottom portion spaced below said top portion and having a conductive surface normal to the axis and a cylindrical portion extending around the space between the top and bottom portions and having a dielectric property;
- four exciter members spaced around the axis within the cylindrical portion, extending without conductive contact through the bottom portion and contacting the conductive surface of the top portion of the first assembly;
- a signal divider/combiner coupled to the four exciter members, positioned below the bottom portion, configured to provide excitation of respective 0, 90, 180 and 270 degree phase to successive ones of the exciter members and having a signal port; and
- a cylindrical base assembly including a cylindrical side wall portion having a signal absorbent property, a base top portion having a signal absorbent property and a conductive surface at the bottom of the side wall and normal to the axis, said base assembly centered around the axis below the first assembly, enclosing the signal divider/combiner and having a transverse dimension larger than the first assembly;
- the antenna is configured to provide a radiation pattern of right-hand circular polarization in all directions, except within a downward cone having an acute internal angle.

In another embodiment, the base assembly may include a cylindrical inner wall, within and concentric to the side wall, and having a signal absorbent property. In this embodiment, the base top portion may be omitted.

For a better understanding of the invention, together with other and further objects, reference is made to the accompanying drawings and the scope of the invention will be addressed by the accompanying claims.

DESCRIPTION OF THE INVENTION

Figure 1:
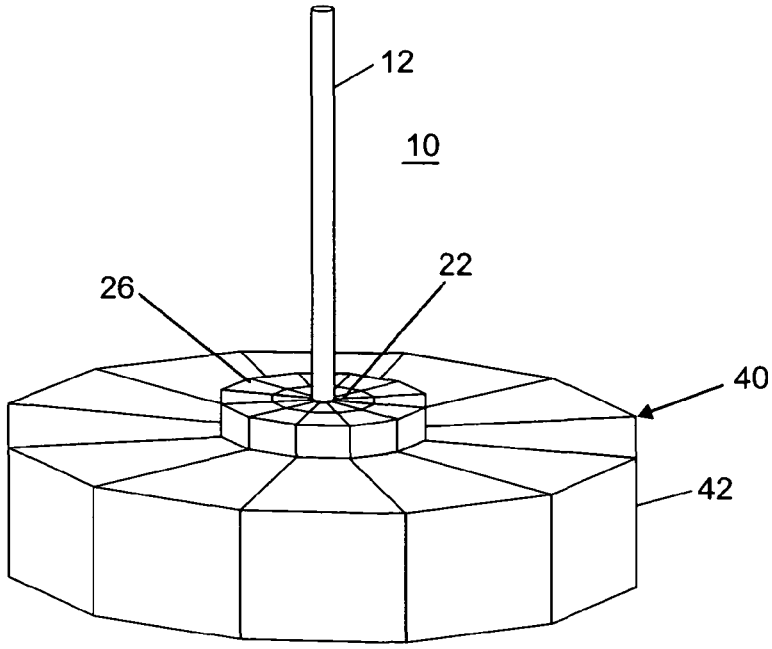
FIG. 1 is a perspective view and FIG. 2 is a side view of an embodiment of an antenna utilizing the invention.
Figure 2:
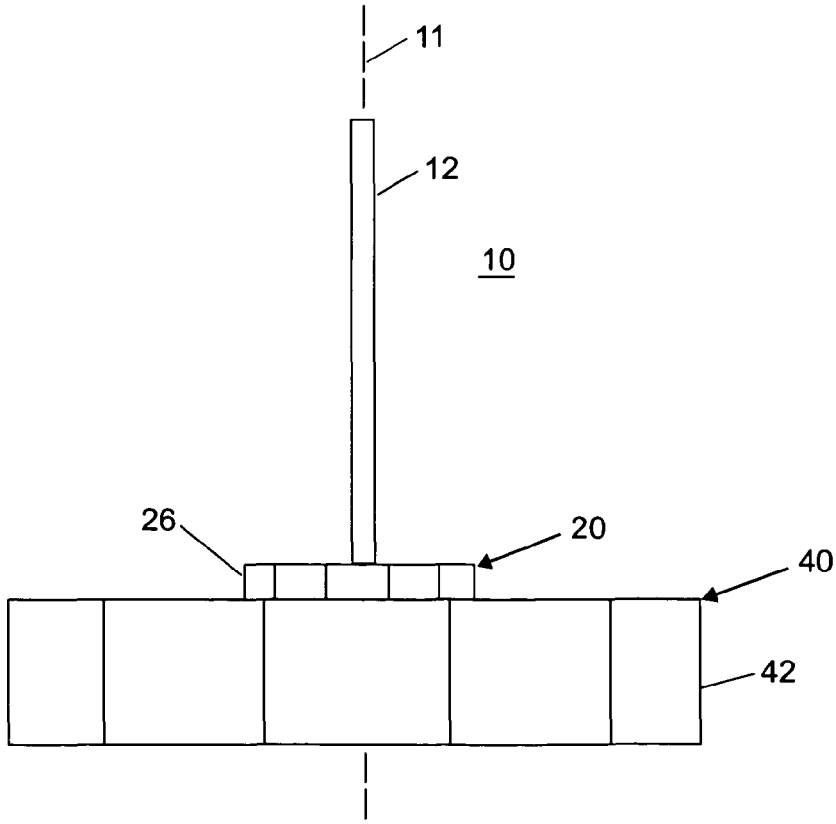

FIGS. 1 and 2 are respectively a perspective view and a side view of an antenna in accordance with an embodiment of the invention. As will be described further, this embodiment is configured to provide a near-spherical antenna pattern of right-hand circular polarization in all directions, except within a downward cone having an acute internal angle approximating 30 degrees.

In this embodiment, antenna 10 has a center axis 11 and comprises a cylindrical first assembly 20 and a cylindrical base assembly 40. The antenna may also include an air terminal 12 in the form of rod of aluminum or other suitable material which extends through the center of the antenna to provide lightning protection in known manner. Other than that function, the antenna and its operation are basically independent of the presence or absence of rod 12. In the drawings, elements of the antenna are presented in a twelve-sided cylindrical computer generated format representative of the presently preferred circular cylindrical construction of the antenna. Any suitable cylindrical format may be employed as appropriate in particular applications.

Figure 3:
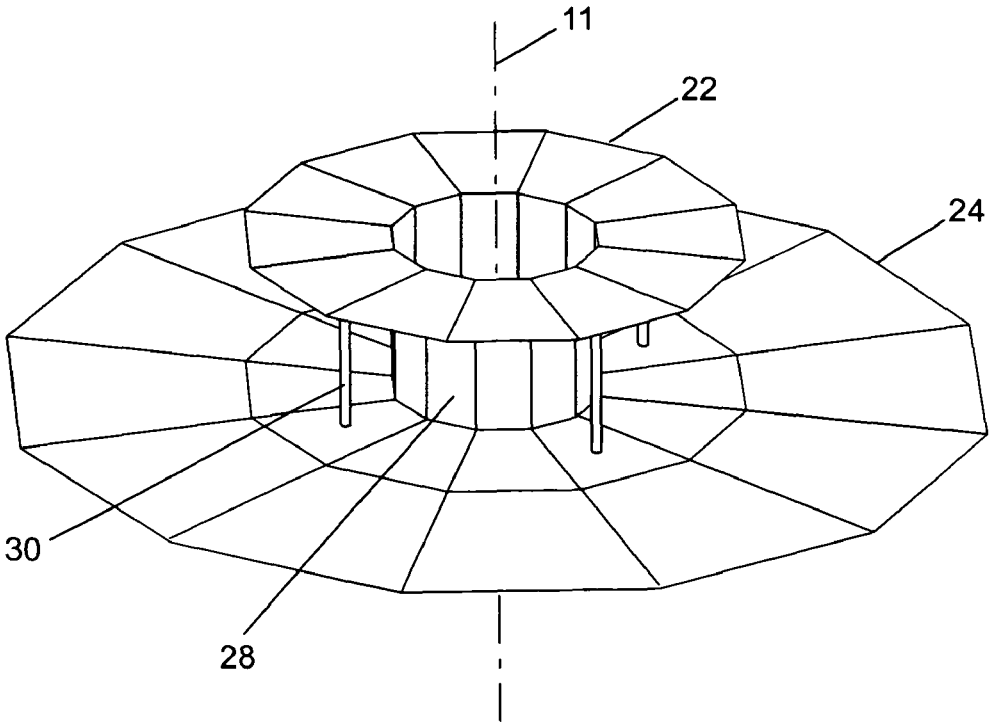
FIG. 3 is a perspective view of a subassembly of an upper first assembly of the antenna of FIGS. 1 and 2.

The first assembly 20, as shown in FIGS. 1, 2 and 3, includes a top portion 22, a bottom portion 24 and a cylindrical portion 26. FIG. 3 is a perspective view of first assembly 20 without rod 12 and with cylindrical portion 26 removed. Top and bottom portions 22 and 24, which are visible in FIG. 3, each include a conductive surface normal to axis 11. Portions 22 and 24 may be disks of conductive material (e.g., aluminum sheet metal), other material with a conductive coating or of other suitable construction. As shown in FIG. 3, in this example there is included a central collar 28 of aluminum or other suitable construction and configured to support top portion 22 spaced above bottom portion 24, while providing a central opening to permit insertion of rod 12.

Not shown in FIG. 3 is cylindrical portion 26 which, in this embodiment, is configured as a cylindrical solid having a central opening (i.e., a ring) sized so that portion 26 may be lowered around top portion 22 to be supported on the upper surface of bottom portion 24. Cylindrical portion 26 has a dielectric property and may be constructed of a dielectric solid or other substantially homogeneous material having a dielectric constant of about 4 in this embodiment. In other embodiments the size, shape, construction and dielectric constant may be as determined to be suitable by skilled persons.

The antenna of FIGS. 1, 2 and 3 also includes four exciter members 30, of which three are partially visible in FIG. 3. Exciter members 30 are, in this embodiment, equally spaced around center axis 11, extending without conductive contact through bottom portion 24 and contacting the conductive surface of top portion 22. Thus, exciter members 30 may have the form of thin conductive rods which pass through bottom portion 24 in a clearance or insulated configuration and make contact with top portion 22. Other exciter configurations may be employed as suitable in other embodiments.

Figure 4:
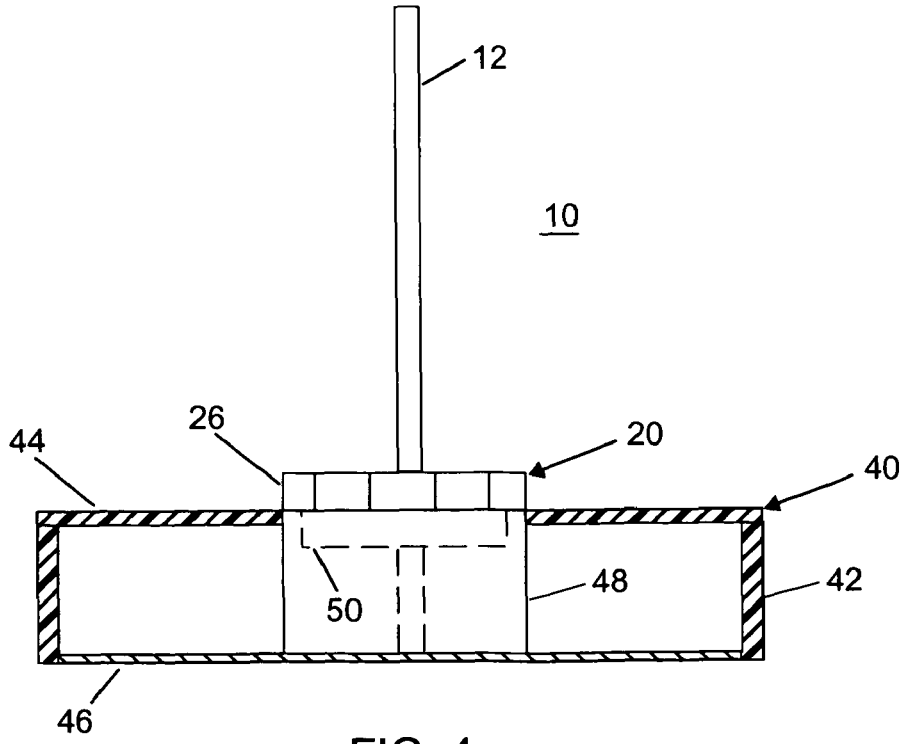
FIG. 4 is a side view of the antenna of FIGS. 1 and 2 with forward sections of outer portions of the base assembly of the antenna removed.

FIG. 4 is a side view as in FIG. 2, however, the outer structure of the cylindrical base assembly 40 has been cut through and the forward half of that outer structure removed to expose the interior of base assembly 40. As visible in FIG. 4, within base assembly 40, is a signal divider/combiner 50 positioned below bottom portion 24 and coupled to the four exciter members 30. Signal divider/combiner 50 is configured, in this embodiment, to provide excitation of respective 0, 90, 180 and 270 degree phase to successive ones of the four exciter members 50. If signals of such phases are applied to exciters which are successively spaced clockwise the next from the preceding, a right-hand circularly polarized antenna pattern will be produced by the antenna, as suitable for the present DGPS applications. Coupling signals of 0, 90, 180 and 270 degree phase to successive exciters each spaced counter-clockwise from the preceding exciter would result in a left-hand circularly polarized antenna pattern, which may be suitable for other applications.

Figure 5:
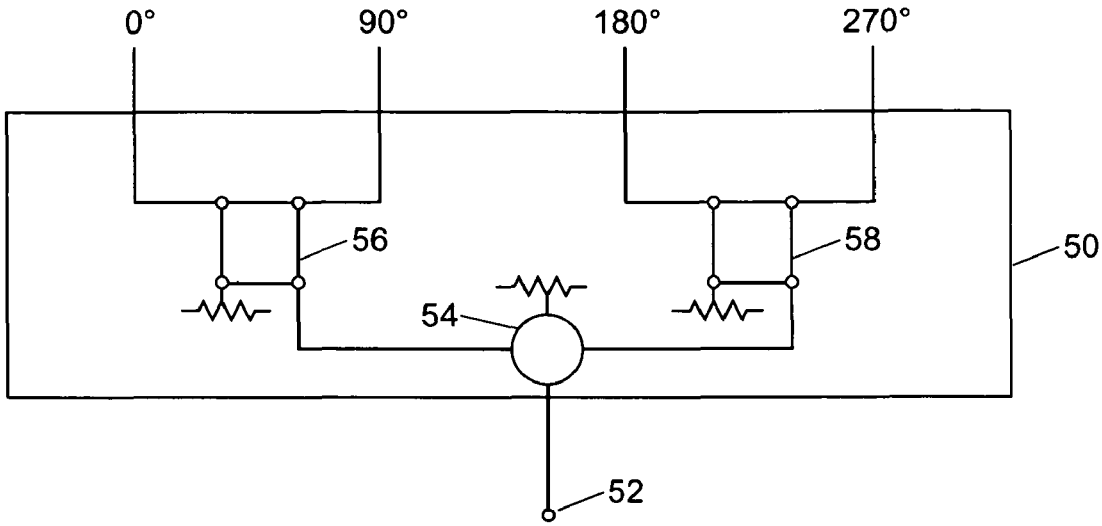
FIG. 5 is a representative simplified circuit diagram of a signal divider/combiner unit included in the antenna of FIGS. 1 and 2.

A form of circuit suitable to provide the described function of signal divider/combiner 50 is shown in FIG. 5. As shown is this example, a signal coupled to signal port 52 is divided into two equal opposite phase signals by hybrid junction 54, which are coupled to directional couplers 56 and 58 arranged to provide four equal outputs of the relative 0, 90, 180 and 270 degree phases indicated, for coupling to the four exciter members 30. While signal transmission terminology is used for convenience, it will be understood that antenna components operate reciprocally to provide signal reception capabilities to receive right-hand circularly polarized GPS signal components which are combined to provide a composite output signal at signal terminal 52 for DGPS use.

Referring further to FIGS. 1,2, and 4, in this embodiment cylindrical base assembly 40 includes a cylindrical side wall portion 42, a base top portion 44, a base bottom portion 46 and an inner enclosure portion 48. Side wall portion 42 and base top portion 44 have a signal absorbent property and may comprise portions of suitable resistance card stock, with side wall portion 42 having a resistance characteristic of 100 Ohms per square and base top portion 44 having a resistance characteristic of 900 Ohms per square, in this example. In particular applications appropriate resistance characteristics may be provided by suitable material bonded to a supportive backing, in a self-supporting configuration or as otherwise determined by skilled persons. As illustrated, base assembly 40 includes base bottom portion 46 which has a conductive surface positioned normal to central axis 11 shown in FIG. 2. Base bottom portion 40 may comprise a disk of aluminum sheet material, a base sheet with a conductive surface or other suitable construction. As shown in FIG. 4, base assembly 40 also includes an inner enclosure portion 48 constructed of metal or other suitable material and configured to both enclose signal divider/combiner 50 and provide support for first assembly 20. As shown, top portion 44 has a central opening fitting around portion 48 so that first assembly 20 may rest directly on top of portion 48. Thus, for definitional purposes, base top portion 44 will be considered to be in proximity to the bottom portion 24 of first assembly 20 and top portion 44 will be considered to be at the top of inner enclosure portion 48. As illustrated in FIG. 4, air terminal rod 12 passes through the various components of the antenna to or through base bottom portion 46 via suitable openings so that it provides a level of lightning protection, substantially independent of interaction with other components of the antenna.

In one presently preferred design embodiment, operable over a wide bandwidth (e.g., 1176 to 1575 MHz) to cover all known satellite navigation systems, antenna dimensions were approximately as follows:

first assembly 20, diameter 4.8 inches; top portion 22, diameter 2.6 inches;

cylindrical portion 26, height 0.8 inches, diameter 4.8 inches;

base assembly 40, diameter 15 inches, height 3.1 inches.

Thus, the base assembly 40 has a transverse dimension (e.g., diameter) larger than the transverse dimension of the first assembly 20, by a factor of about 3, in this embodiment. In this configuration, the bottom portion 24 of the first assembly has a transverse dimension corresponding to that of cylindrical portion 26, with the word corresponding defined for present purposes as meaning the same or nearly the same.

Figure 6:
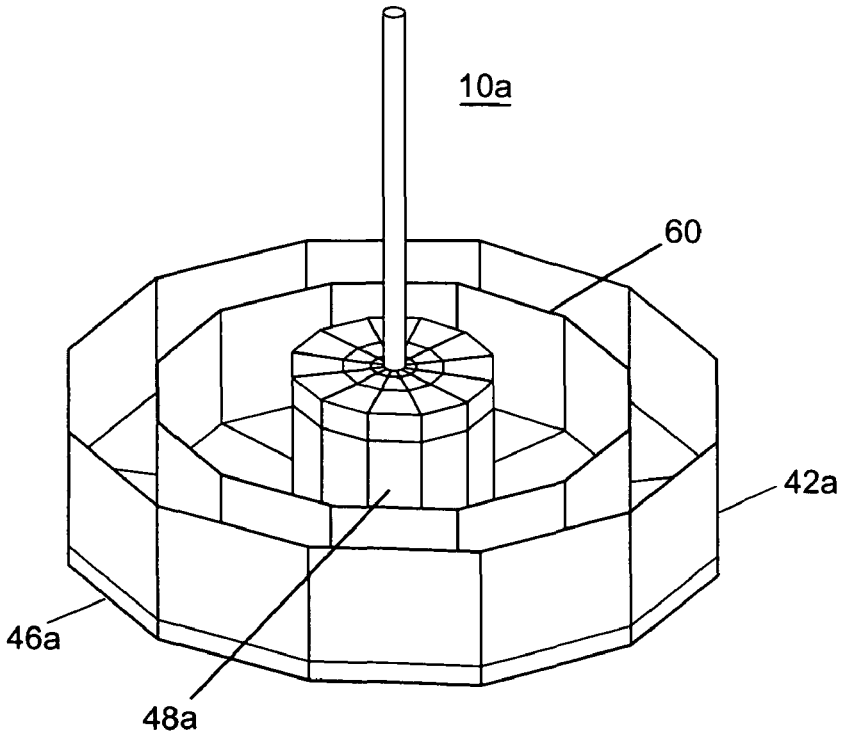
FIG. 6 is a perspective view of another embodiment of an antenna utilizing the invention.

FIG. 6 illustrates an additional embodiment of an antenna utilizing the invention. In FIG. 6, overall dimensions and antenna elements may be similar or identical to the antenna of the preceding drawings, with the exceptions that base top portion 44 is not present and an inner side-wall portion 60 is positioned inside of and concentric with sidewall portion 42*a*. In this embodiment inner sidewall portion 60 may have a diameter of 11 inches. Similarly to sidewall portion 42*a*, inner sidewall portion 60 is provided of suitable construction having a signal absorbent property and may have a resistance characteristic of 400 Ohms per square in this embodiment. In the FIG. 6 antenna as illustrated, base bottom section 46*a* has a transverse dimension corresponding to that of side wall portion 42*a* and may extend under the bottom edge of side wall portion 42*a*, as shown. For purposes of illustration, certain antenna elements are shown without thickness, however, it will be understood that all elements have a suitable finite thickness.

The antennas as shown may also include a protective radome of suitable form, shape and signal transmissive properties as determined by skilled persons in particular applications. Other mechanical details, such as arrangements for mounting an antenna to a supporting structure may also be determined by skilled persons, as appropriate.

Operationally, it has been determined by computer analysis that the antenna shown in FIGS. 1, 2 and 4 is effective to provide a near-spherical pattern of right-hand circular polarization in all directions, except within a downward cone (i.e., centered around center axis 11) having an acute internal angle (i.e., an internal angle of 90 degrees or less). More particularly this antenna has been shown to provide an antenna pattern of right-hand circular polarization for all incident angles, except within a downward cone having an acute internal angle of 30 degrees. It will be appreciated that in an application such as use on an aircraft carrier, for example, an antenna will necessarily be mounted at a significant distance above the reflective surface of the ocean or other body of water. In such an environment, the antenna will be subject to the incidence of strong reflected signals at incidence angles at the antenna which will have large negative angular values below the horizon. In addition, in shipboard use an antenna may typically be subjected to strong laterally reflected signals. Such signals may be reflected from nearby masts, other antennas and other shipboard objects. Such reflected signal would represent a strong multipath signal capable of introducing unacceptable errors in the derivation of accurate DGPS data critical to the providing of positional correction information to approaching aircraft during landing operations on an aircraft carrier. A present antenna, providing a near-spherical right-hand circular polarization antenna pattern extending below the horizon to negative 75 degrees (i.e., except within a downward 30 degree cone) would provide polarization discrimination effective in suppressing antenna reception of such a reflected signal which will exhibit left-hand circular polarization after it is reflected. With antennas as described, a good axial ratio characteristic is provided for right-hand circular polarization for all elevation angles above about negative 75 degrees elevation. Supporting the accurate reception of GPS signals, while minimizing the introduction of signal phase errors, computed performance includes a phase center location of 6.3 to 9.5 mm. above the center of the cylindrical first assembly 20 across the frequency band, with a phase center stability within a range of plus or minus 2.5 mm.

Figure 7:
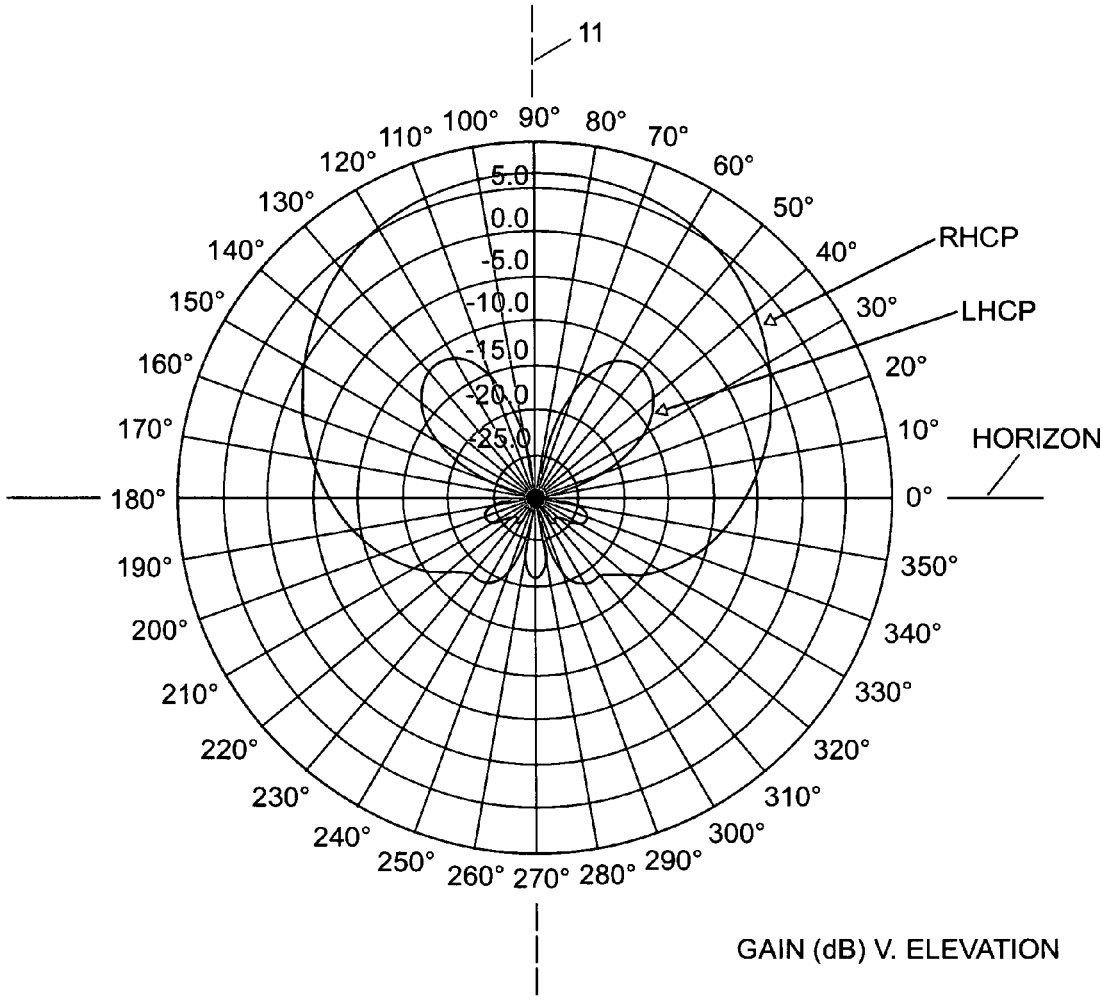
FIG. 7 is a computer plot of gain v. elevation angle for the antenna of FIGS. 1 and 2 and illustrates suppression of reception of left-hand circular polarization signals for signals incident in all directions, except within a downward cone having an internal angle of about 30 degrees.

FIG. 7 is a computer plot of gain v. elevation angle for the antenna of FIGS. 1 and 2 at a frequency of 1575 MHz, which is representative of performance at other frequencies within an operating band of 1176 to 1575 MHz. In this plot, antenna gain for undesired reception of signals of left-hand circular polarization (i.e., reflected multipath signals) is confined within the negative 15 dB gain circle. With reference to the superimposed antenna center axis line 11 and horizon line, it will be seen that the left-hand circular polarization plot includes a predominant lobe centered at about 50 degrees elevation above horizon, a minor lobe centered at about 20 degrees below horizon and a downward lobe having a gain of less than negative 25 dB. More significantly, the outer plot of gain for reception of desired right-hand polarization signals, which exceeds the previously discussed left-hand polarization gain by about 15 dB, is adequate to enable reception of the desired right-hand polarization signals, with suppression of any undesired left-hand polarization signals resulting from multipath reflection. As will be seen, discrimination against reception of left-hand circular polarization signals is not provided within a downward cone of 30 degrees internal angle in which the near-spherical plot of right-hand polarization gain dips toward zero and there is a downward lobe representing a gain of negative 25 dB for reception of signals of left-hand circular polarization. However, since for reception in this downward 30 degree cone signals would have to be incident from a direction almost directly under the antenna, and would thereby be blocked by the by the bottom reflective surface of the antenna or the underlying structure supporting the antenna, the possibility of system errors produced by such signals is remote. Thus, in summary, the gain data provided in FIG. 3 shows that suppression of reflected multipath signals of left-hand polarization is provided at all azimuths at all elevation angles of interest, while gain effective for reliable reception of right-hand polarization signals is provided for all directions, except within a downward cone of 30 degrees internal angle.

While there have been described currently preferred embodiments of the invention, those skilled in the art will recognize that other and further modifications may be made without departing from the invention and it is intended to claim all modifications and variations as fall within the scope of the invention.

What is claimed is:

1. An antenna, providing a near-spherical antenna pattern of right-hand circular polarization, comprising:

a cylindrical first assembly having a center axis and including a top portion having a conductive surface normal to said axis, a bottom portion spaced below said top portion and having a conductive surface normal to said axis and a cylindrical portion extending around the space between said top and bottom portions and having a dielectric property;

four exciter members spaced around said axis within said cylindrical portion, extending without conductive contact through said bottom portion and contacting the conductive surface of said top portion;

a signal divider/combiner coupled to said four exciter members, positioned below said bottom portion, configured to provide excitation of respective 0, 90, 180 and 270 degree phase to successive ones of said exciter members and having a signal port; and a cylindrical base assembly including a cylindrical side wall portion having a signal absorbent property and a conductive surface at the bottom of said side wall and normal to said axis, said base assembly centered around said axis below said first assembly, enclosing said signal divider/combiner and having a transverse dimension larger than said first assembly;

said antenna configured to provide a radiation pattern of right-hand circular polarization in all directions, except within a downward cone having an acute internal angle.

2. An antenna as in claim 1, wherein said cylindrical portion of the first assembly is a ring of dielectric material.

3. An antenna as in claim 1, wherein said top portion and bottom portion of the first assembly are metal disks.

4. An antenna as in claim 1, wherein said bottom portion of the first assembly is a metal disk with a transverse dimension corresponding to that of said cylindrical portion and said top portion of the first assembly is a metal disk with a transverse dimension not exceeding the transverse dimension of a central opening in said cylindrical portion.

5. An antenna as in claim 1, wherein said side wall portion of the base assembly comprises resistance card material configured to form a cylindrical wall.

6. An antenna as in claim 1, wherein said base assembly additionally includes a base top portion, with a signal absorbent property, positioned at the top of said side wall portion and in proximity to said bottom portion of the first assembly.

7. An antenna as in claim 1, wherein said base assembly additionally includes a cylindrical inner wall, within and concentric to said side wall.

8. An antenna as in claim 1, wherein said conductive surface at the bottom of the sidewall of the base assembly is a surface of a metal disk.

9. An antenna as in claim 1, wherein said transverse dimension of the base assembly is at least three times the transverse dimension of said first assembly.

10. An antenna, providing a near-spherical antenna pattern of right-hand circular polarization, comprising:

a ring portion having a dielectric property, a first transverse dimension and a center axis;

a first top portion positioned at the top of said ring portion and having a conductive surface normal to said axis;

a first bottom portion positioned at the bottom of said ring portion and having a conductive surface normal to said axis;

four exciter members spaced around said axis within said ring portion, extending without conductive contact through said first bottom portion and contacting the conductive surface of said first top portion;

a signal divider/combiner coupled to said four exciter members, positioned below said first bottom portion, configured to provide equal excitation of respective 0, 90, 180 and 270 degree phase to successive ones of said exciter members and having a signal port; and a cylindrical base portion having a signal absorbent property, positioned below said first bottom portion enclosing said signal divider/combiner, having a transverse dimension larger than said ring portion and centered around said axis; and a base bottom portion positioned at the bottom of said cylindrical base portion and having a conductive surface normal to said axis;

said antenna configured to provide a radiation pattern of right-hand circular polarization in all directions, except within a downward cone having an acute internal angle.

11. An antenna as in claim 10, wherein said ring portion is a ring of dielectric material.

12. An antenna as in claim 10, wherein said first bottom portion is a metal disk and said first top portion is a metal disk with a transverse dimension not exceeding the transverse dimension of a central opening of said ring portion.

13. An antenna as in claim 10, additionally comprising a base top portion, with a signal absorbent property, positioned at the top of said cylindrical base portion and in proximity to said first bottom portion.

14. An antenna as in claim 10, additionally comprising a cylindrical inner wall within and concentric to said cylindrical base portion and having a signal absorbent property.

15. An antenna as in claim 10, wherein said base bottom portion is a metal disk.

16. An antenna, usable for reception of GPS satellite signals, comprising:

a cylindrical first assembly having a center axis, a top conductive surface, a bottom conductive surface spaced below said top conductive surface, four exciter members spaced around said axis, extending through said bottom conductive surface without conductive contact therewith and contacting said top conductive surface, and a dielectric portion extending around said exciter members;

a signal divider/combiner coupled to said exciter members and configured to excite said exciter members at respective 0, 90, 180 and 270 degree phases; and a cylindrical base assembly centered on said axis below said first assembly, having a transverse dimension larger than said first assembly, having a side wall with a signal absorbent property extending around said signal divider/combiner and having a base conductive surface at the bottom of said side wall.

17. An antenna as in claim 16, wherein said top and bottom conductive surfaces of said first assembly are surfaces of respective metal disks and said dielectric portion is a ring of dielectric material.

18. An antenna as in claim 16, wherein said base assembly additionally includes a base top portion, with a signal absorbent property, positioned at the top of said side wall and in proximity to said bottom conductive surface of said first assembly.

19. An antenna as in claim 16, wherein said base assembly additionally includes a cylindrical inner wall within and concentric to said side wall and having a signal absorbent property.

20. An antenna as in claim 16, wherein said conductive surface at the bottom of the sidewall of the base assembly is a metal disk.

* * * * *